US010343808B2

(12) United States Patent
Bardini

(10) Patent No.: US 10,343,808 B2
(45) Date of Patent: Jul. 9, 2019

(54) LABELING MACHINE

(71) Applicant: P.E. LABELLERS S.P.A., Porto Mantovano (IT)

(72) Inventor: Riccardo Bardini, Rodigo (IT)

(73) Assignee: P.E. LABELLERS S.P.A., Porto Mantovano (IT)

( * ) Notice: Subject to any disclaimer, the term of this patent is extended or adjusted under 35 U.S.C. 154(b) by 0 days.

(21) Appl. No.: 15/310,736

(22) PCT Filed: May 6, 2015

(86) PCT No.: PCT/EP2015/059977
§ 371 (c)(1),
(2) Date: Nov. 11, 2016

(87) PCT Pub. No.: WO2015/173091
PCT Pub. Date: Nov. 19, 2015

(65) Prior Publication Data

US 2017/0081070 A1 Mar. 23, 2017

(30) Foreign Application Priority Data

May 15, 2014 (IT) ..... VR2014A0132

(51) Int. Cl.
*B65C 9/18* (2006.01)
*B65C 9/32* (2006.01)

(52) U.S. Cl.
CPC ..... *B65C 9/1803* (2013.01); *B65C 9/32* (2013.01); *B65C 2009/1838* (2013.01)

(58) Field of Classification Search
CPC ..... B65C 9/1803; B65C 9/1838; B65C 9/32; B65C 2009/1838
See application file for complete search history.

(56) References Cited

U.S. PATENT DOCUMENTS 6,450,230 B1 9/2002 Otruba
6,471,802 B1 * 10/2002 Williamson ..... B65C 9/1819 156/250

(Continued)

FOREIGN PATENT DOCUMENTS

DE 1255567 11/1967
DE 2542383 4/1976

(Continued)

OTHER PUBLICATIONS

Italian Priority Search Report IT VR20140132, completed Jan. 26, 2015.

(Continued)

*Primary Examiner* — Mark A Osele
*Assistant Examiner* — Christopher C Caillouet
(74) *Attorney, Agent, or Firm* — Thompson Hine LLP

(57) ABSTRACT

A labeling machine that comprises elements for entraining a tape along an advancement path with respect to a cutting device that has at least one blade adapted to cut the tape in order to obtain labels, the blade being arranged laterally spaced apart with respect to the advancement path of the tape, elements for redirecting at least one portion of the tape from the advancement path being also provided which are adapted to move such portion with respect to the advancement path of the tape in the direction of the blade in order to allow the blade to cut the tape at the aforementioned portion.

15 Claims, 8 Drawing Sheets

(56) References Cited

U.S. PATENT DOCUMENTS

| | | | | |
|---|---|---|---|---|
| 2001/0017181 | A1 | 8/2001 | Otruba | |
| 2005/0184426 | A1* | 8/2005 | Bomba | B29C 47/92 264/166 |
| 2010/0018650 | A1* | 1/2010 | Ballarotti | B65C 9/1819 156/446 |
| 2012/0234495 | A1 | 9/2012 | Ballarotti | |

FOREIGN PATENT DOCUMENTS

| | | |
|---|---|---|
| JP | S58-217297 | 12/1983 |
| JP | H02-066990 | 5/1990 |

OTHER PUBLICATIONS

Written Opinion of the International Searching Authority, International Application No. PCT/EP2015/059977, International Filing Date May 6, 2015.

International Search Report, International Application No. PCT/EP2015/059977, International Filing Date May 6, 2015.

JP, English translation of Office Action Summary issued in Japanese patent application No. 2016-567765, 2 pages (dated Feb. 19, 2019).

* cited by examiner

LABELING MACHINE

The invention relates to a labeling machine.

Labeling machines are known which have a rotating cutting roller, which is adapted to receive a tape to be cut from an unwinding roller and which is provided with at least one blade, which, by interfering with a stationary counter-blade, slightly inclined with respect to the blade of the cutting roller, produces a gradual cutting of the tape, in a manner similar to a scissors, so as to obtain individual labels.

The labels obtained on the cutting roller are subsequently made to adhere to a transfer drum, which brings them into contact with a gluing roller, which deposits a layer of adhesive onto them, and subsequently transfers them onto a respective container in transit on a rotating carousel.

These labeling machines present a certain difficulty in setting up, and they require very fine tolerances to be maintained for executing the cutting.

Another disadvantage of these machines is constituted by the fact that the "pitch" of cutting, which determines the format of the labels, i.e. the maximum length of the labels that can be made, is defined by the angular distance between the blades arranged on the cutting roller, and it cannot therefore be varied without intervening with complex operations to substitute elements.

In order to seek to overcome this drawback, labeling machines have been devised, as described for example in German utility model no. DE202005002793U1, in which, adjacent to a cutting roller, there is also a rotating cutting counter-roller, which has, on its lateral surface, a pair of mutually opposite blades which are fixed thereto.

With this solution, by varying the rotation speed of the cutting roller and of the cutting counter-roller, it is possible to vary the pitch of cutting the tape, thus obtaining labels of various different lengths.

However, this solution also requires very fine tolerances for its correct operation.

As disclosed in EP0944528, other known labeling machines have a cutting and transfer drum, which receives onto it, from an unwinding roller, the tape to be cut, keeping it in contact on its lateral surface by way of the application of a vacuum.

The cutting and transfer drum supports a plurality of blades, angularly mutually spaced apart, which are selectively moved by a pneumatic system, with a rotating guillotine motion, downward from above, so as to gradually cut the tape along a cutting line, in order to obtain labels of the desired length.

Subsequently, the labels made on the cutting and transfer drum receive a layer of adhesive from a spraying device and are then transferred from the same cutting and transfer drum onto respective containers carried by a carousel.

With machines of this type, pre-glued labels can also be used, i.e. labels made starting from a tape that has, already on the spool, a layer of adhesive pre-applied to a surface thereof.

This solution, while allowing a certain versatility in changing the format of the labels, thanks to the ability to selectively move the blades, has, however, a relatively high cost, owing to the complexity of the system for moving the blades.

In a further known solution, of the type of that disclosed in EP2091822 by the same Applicant, there are blades on the cutting and transfer drum which have an inclined cutting edge with respect to the surface of the roller on which the tape to be cut rests and which are moved by brushless motors with translational motion, again obtaining a gradual cutting of the tape.

This solution also, although offering like the previous solution the ability to change the pitch and even though it also allows the use of pre-glued labels, suffers the disadvantage of still being complex in terms of construction and of having, therefore, a relatively high cost.

In EP2024148 by the same Applicant, a cutting device is disclosed which has a blade moved by actuation means toward the tape to be cut and which has a cutting edge that is inclined with respect to the surface of the tape.

The aim of the present invention is to provide a labeling machine equipped with a cutting device that makes it possible to obtain, extremely economically, the cutting of the tape in order to obtain labels with the possibility of varying the pitch of cutting.

Within this aim, an object of the present invention is to provide a labeling machine that makes it possible to operate at high speeds so as to allow the machine to reach an extremely high rate of productivity.

Another object of the present invention is to provide a labeling machine that can be validly used irrespective of whether the labels are to be glued with adhesive or are pre-glued.

This aim and these and other objects which will become better apparent hereinafter are achieved by the labeling machine, according to the invention, as defined in claim 1.

Further characteristics and advantages of the invention will become better apparent from the description of some preferred, but not exclusive, embodiments of the labeling machine, according to the invention, which are illustrate, by way of non-limiting example, in the accompanying drawings wherein.

Figure 1:
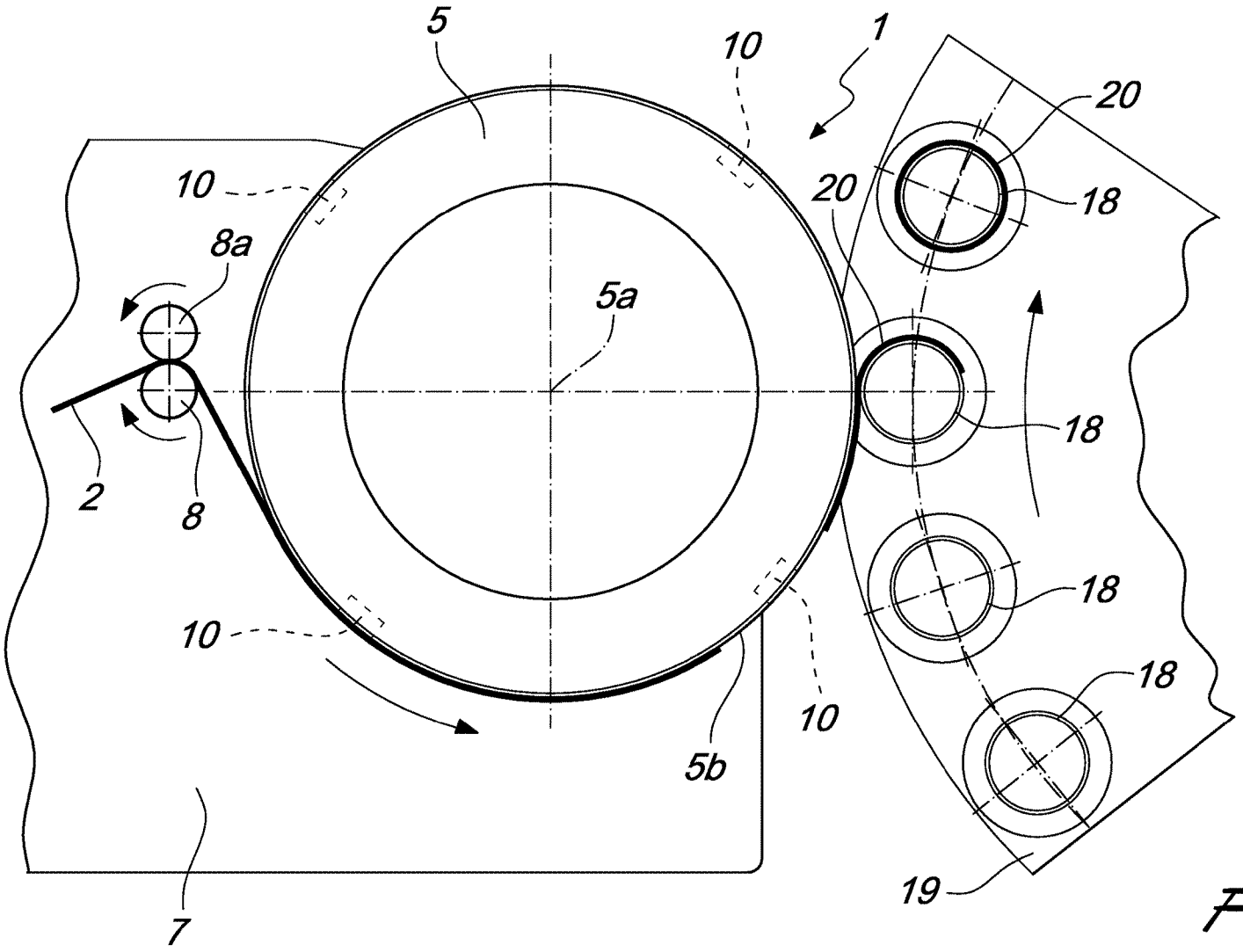
FIG. 1 is a schematic plan view from above of a portion of a labeling machine according to the invention.

With reference to the figures, the labeling machine, according to the invention, generally indicated with 1, comprises entrainment means, which make it possible to move and unreel a tape 2 along an advancement path with respect to a cutting device.

The cutting device is provided with at least one blade 3 adapted to cut the tape 2 in order to obtain labels to be applied on containers, such as for example the bottles indicated with 18.

The tape 2 is moved along the advancement path with respect to the blade 3.

According to the invention, the blade 3 is arranged laterally spaced apart with respect to the advancement path of the tape 2.

Also according to the invention, there are redirection means 4, better described below, the function of which is to move at least one portion 2*a* of the tape 2 from its advancement path in the direction of the blade 3 in order to allow the blade to cut the tape 2 at such portion 2*a*.

Conveniently, the blade 3 is oriented so as to present at least one cutting profile 3*a* which is arranged so as to face a face of the tape 2 and which extends substantially at right angles to the longitudinal extension of the tape.

It should be noted that the blade 3 and, more specifically, the cutting profile 3*a* can be shaped in any suitable way, i.e. with a cutting edge that is serrated, straight, variously notched and so on.

Advantageously, at least one portion of the advancement path of the tape 2 is defined by a supporting roller 5, which is mounted so that it can rotate about its own axis 5*a* and which is adapted to receive the tape 2 so that it adheres to its own lateral surface 5*b*.

More specifically, the supporting roller 5 is, preferably, mounted rotatably on a base 6, which can be, for example, supported in turn by the frame 7 of the labeling machine.

Conveniently, the supporting roller 5 is adapted to receive the tape 2 from at least one unwinding roller 8 that takes it from a spool or from other, intermediate devices. Optionally, the unwinding roller 8 can be combined with an unwinding counter-roller 8*a*, rotating in the opposite direction.

Advantageously, in a way that is known per se, on the lateral surface 5*b* of the supporting roller 5 there are openings 9*a*, which are connected to aspiration ducts 9 defined inside the supporting roller 5, which make it possible to retain the tape 2 so that it adheres to the lateral surface 5*b* of the supporting roller 5.

Conveniently, the blade 3 rotates integrally with the supporting roller 5 and is arranged, at least with its cutting profile 3*a*, in a position that is spaced apart with respect to the lateral surface 5*b* of the supporting roller 5.

More specifically, the blade 3 is arranged between the lateral surface 5*b* of the supporting roller 5 and the axis 5*a* of the supporting roller 5 and, in such case, the redirection means 4 operate so as to move, with respect to the lateral surface 5*b* of the supporting roller 5 and toward the axis 5*a* of the supporting roller 5, each portion 2*a* of the tape 2 on which it is desired to carry out the cutting, in order to thus bring it into contact with the cutting profile 3*a* of the blade 3 or in any case proximate thereto.

Preferably, at least during the execution of the cutting of the tape 2, the blade 3 is kept fixed at least with respect to portions 2*b* of the tape 2 which are arranged adjacent to the portion 2*a* made to move by the redirection means 4.

More specifically, as in the example shown, the blade 3 is rigidly fixed to the supporting roller 5, i.e. connected to the supporting roller 5.

In this manner, the cutting of the tape 2 by the blade 3 occurs by way of the mere movement of the portion 2*a*, which is actuated by the redirection means 4 toward said blade, which remains stationary.

Alternatively, it is also possible, in order to obtain the cutting of the tape 2 at the portion 2*a*, for the blade 3 to be actuated so as to move with respect to said portion 2*a*, by way of actuation means, not shown.

In this case, the cutting of the tape 2 at its portion 2*a* occurs not only following the movement actuated by the means 4 of redirection of the portion 2*a* toward the blade 3, but also following the movement of the blade 3 with respect to the portion 2*a*.

For example, still in this case, it is possible for the redirection means 4 to execute the movement of the portion 2*a* of the tape 2 toward the blade 3, until it is brought to rest against the cutting profile 3*a* of the blade 3, and for the cutting of the tape 2 to be carried out subsequently, or in any way completed, by way of a movement imparted to the blade 3 with respect to the tape 2.

Conveniently, such solution can be provided by having the blade 3 supported by the supporting roller 5 with the possibility of movement with respect thereto, for example along a diametrical plane, and by having it connected to respective actuation means, which can be of the pneumatic or electromechanical type, and which again are supported by the supporting roller 5.

Preferably, as illustrated, the blade 3 is accommodated in a chamber 10, which is open toward a face of the tape 2 and is adapted to receive the portion 2*a* following the movement of that portion, with respect to the advancement path of the tape 2, actuated by the redirection means 4.

Figure 2:
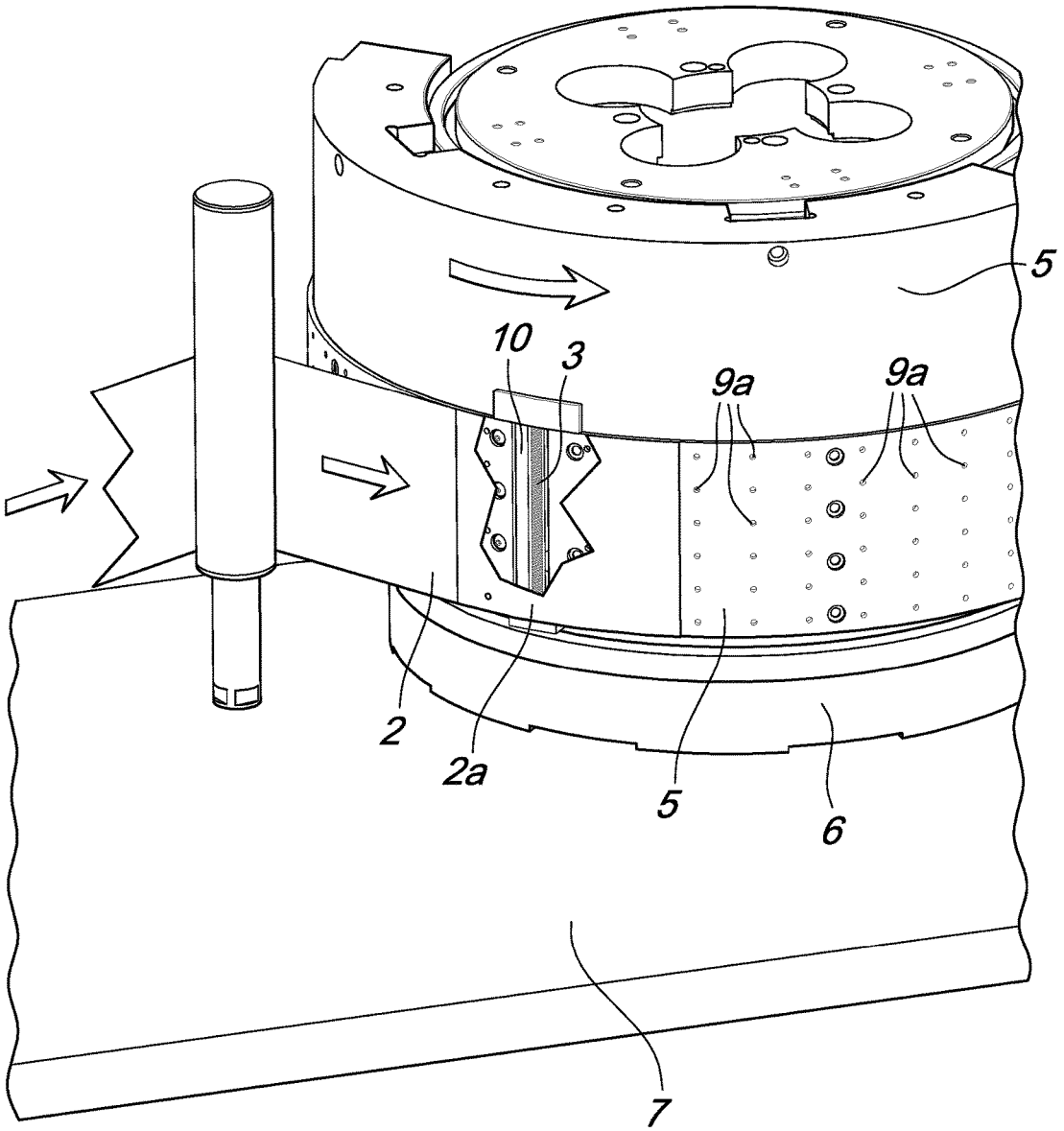
FIG. 2 is a partial perspective view of a possible embodiment of a cutting device comprised in the machine according to the invention, showing a supporting roller on which a tape, shown partially cutaway, is adapted to adhere.

As illustrated in particular in FIG. 2, the chamber 10 can be provided, for example, by a slot, with a substantially axial extension, defined on the lateral surface 5*b* of the supporting roller 5.

As can be seen from FIG. 1, the cutting device according to the invention can, conveniently, be provided with two or more blades 3, which can, advantageously, be associated, integrally in rotation, with the supporting roller 5, so as to be arranged angularly spaced apart from each other, about the axis 5*a* of the supporting roller.

In this manner, it is possible to obtain labels of different length, as a function of the blades 3 used in each instance to cut the tape 2.

The number of blades 3 associated with the supporting roller 5 can thus vary according to the requirements of changing the format of the labels.

Each blade 3 can, in this case, be accommodated within a respective chamber 10, which is open onto the lateral surface 5*b* of the supporting roller 5, thus being spaced apart, with the corresponding cutting profile 3*a*, from the lateral surface 5*b* of the supporting roller 5, as described above.

For the sake of simplicity, reference will continue to be made below to one blade 3 and to the corresponding chamber 10, since the other blades 3 and chambers 10 that are present can be absolutely identical.

According to a possible embodiment, the redirection means 4 comprise means for differentiating the pressure of the air that acts on one face of the tape 2 with respect to the pressure of the air that acts on the other face of that tape.

In particular, the redirection means 4 can, in this case, comprise, for example, means for aspirating air from the side of the face of the tape 2 which is directed toward the blade 3.

Such aspiration means conveniently act in a region that is adjacent to the blade 3 and, more specifically, they are, advantageously, connected to the chamber 10 in which the blade 3 is accommodated.

Figure 3:
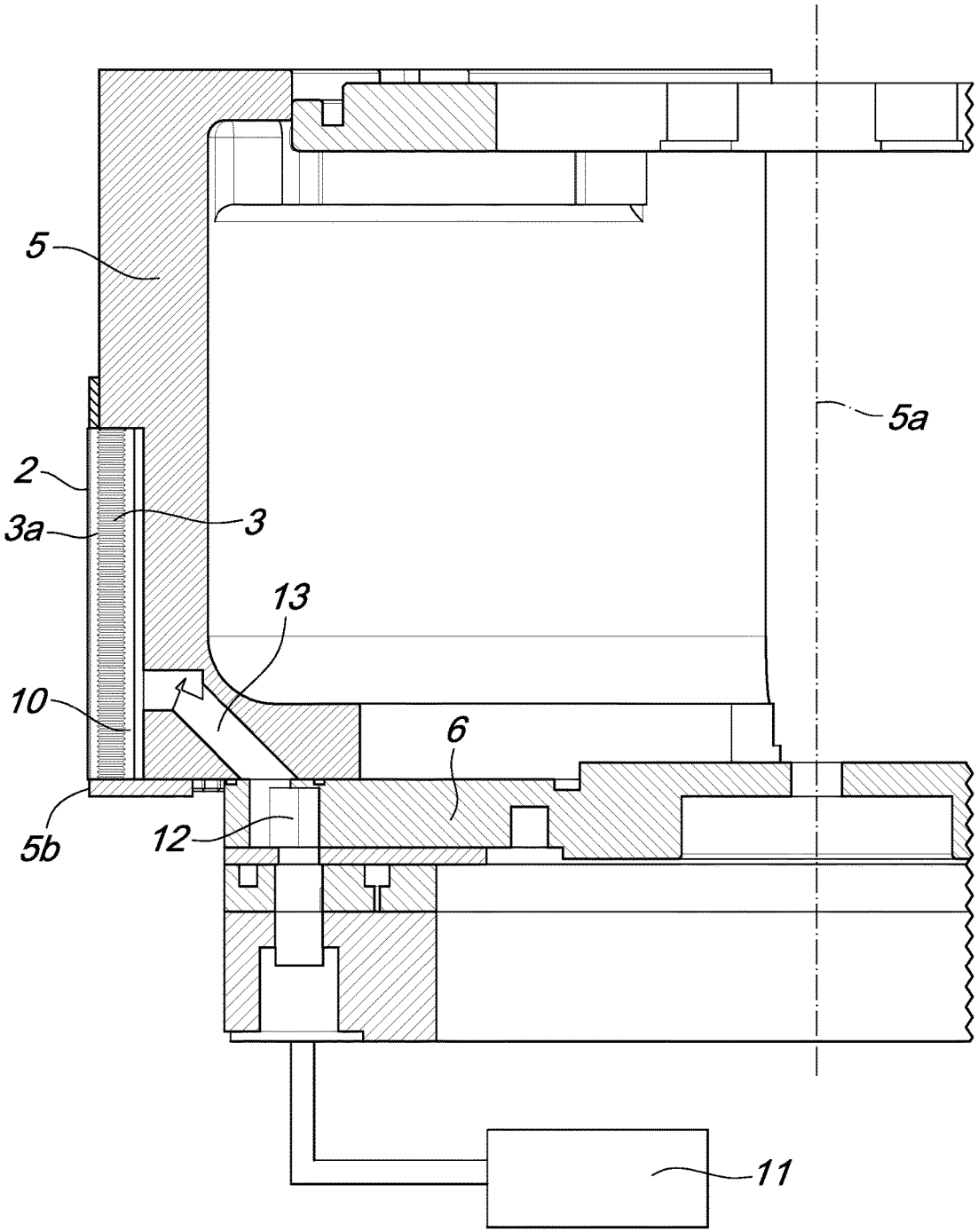
FIG. 3 is a cross-sectional view, taken along a diametrical plane of the supporting roller, of a detail of the embodiment in FIG. 2.
Figure 4:
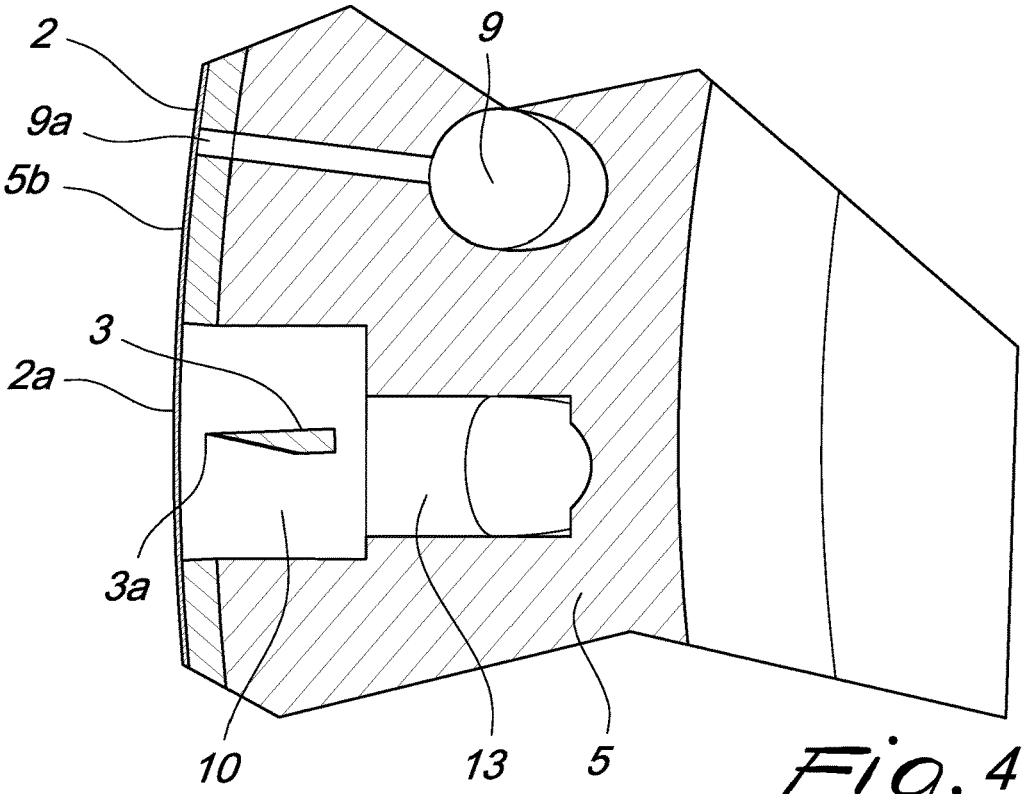
FIG. 4 is a cross-sectional view, taken along a plane perpendicular to the axis of the supporting roller, of a detail of the cutting device, in the embodiment in FIG. 2.

As in the example shown, in particular in FIG. 3, the aspiration means can comprise at least one device 11 for the aspiration of air, which is constituted, for example, by a vacuum pump or the like and is connected with at least one passage channel 12, which is provided within the base 6.

The chamber 10 is, in turn, connected to a respective air aspiration channel 13, which is defined in the supporting roller 5 and which, during the rotation of the supporting roller 5, becomes connected to the passage channel 12 present in the base 6.

Figure 5:
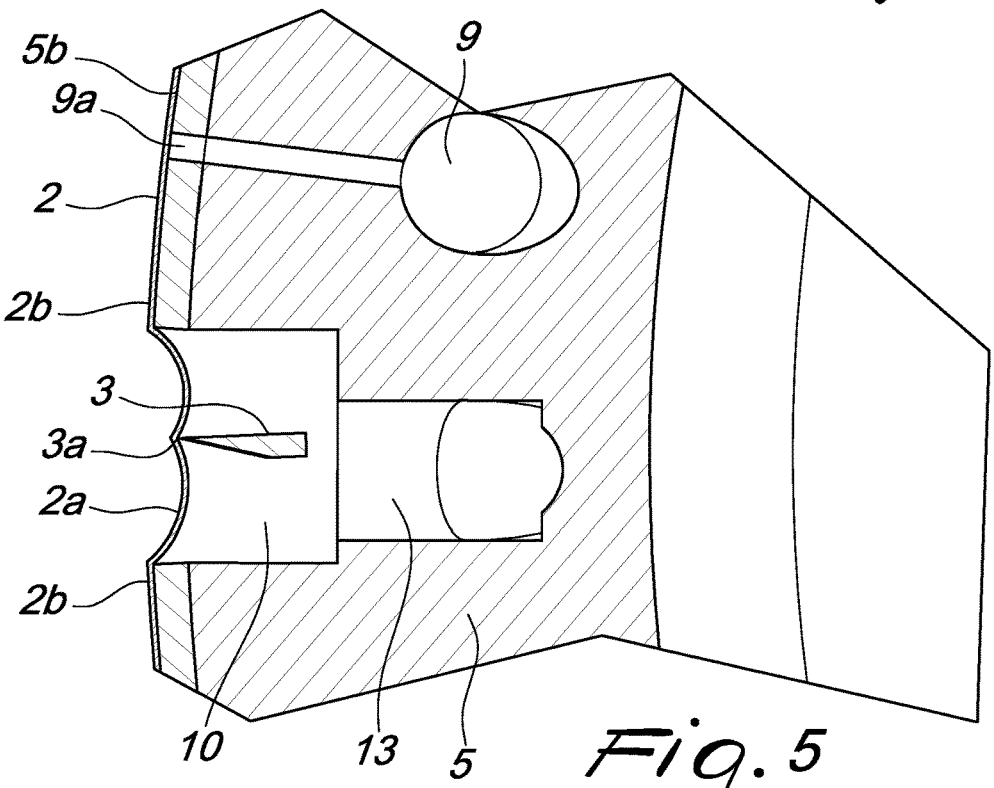
FIGS. 5 and 6 are cross-sectional views, taken along a plane perpendicular to the axis of the supporting roller, of two separate steps of the operation of the cutting device in the embodiment in FIG. 2.

Activation of the air aspiration device 11 thus makes it possible to create, when the air aspiration channel 13 is at the passage channel 12, a partial vacuum within the chamber 10 which makes it possible to suck the portion 2*a* of the tape 2 which is at the chamber 10 into that chamber, as a consequence redirecting it from the advancement path followed by the rest of the tape 2, in order to make it approach the blade 3, possibly until it is brought into contact with the cutting profile 3*a* of that blade, preferably with one of its portions which extends for its entire transverse dimension, as shown in FIG. 5.

Figure 6:
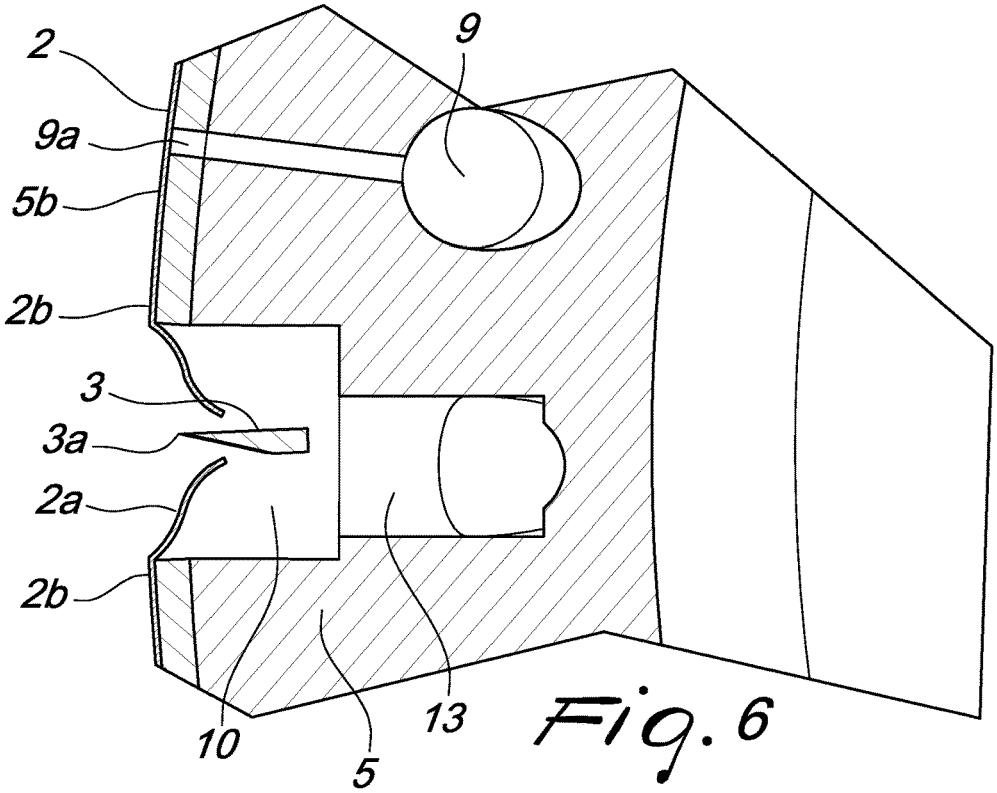

The thrust undergone by the portion 2*a*, by way of the partial vacuum created in the chamber 10, against the blade 3 can be such as to produce the cutting of the tape 2, as shown in FIG. 6, without there being movement of the blade 3 with respect to the tape 2.

Such cutting occurs practically simultaneously, and not gradually, along the entire portion of the tape 2 which comes up against the cutting profile 3*a* of the blade 3.

It should be noted, furthermore, that the cutting of the tape 2 occurs in a position that is spaced apart from the lateral surface 5*b* of the supporting roller 5 which defines, in practice, the advancement path of the tape 2, in that the blade 3 is arranged on a smaller diameter than that of the lateral surface 5*b* of the supporting roller 5.

There is no reason why, as mentioned above, the cutting cannot be done or in any case completed by a movement impressed on the blade 3 by actuation means thereof.

Figure 7:
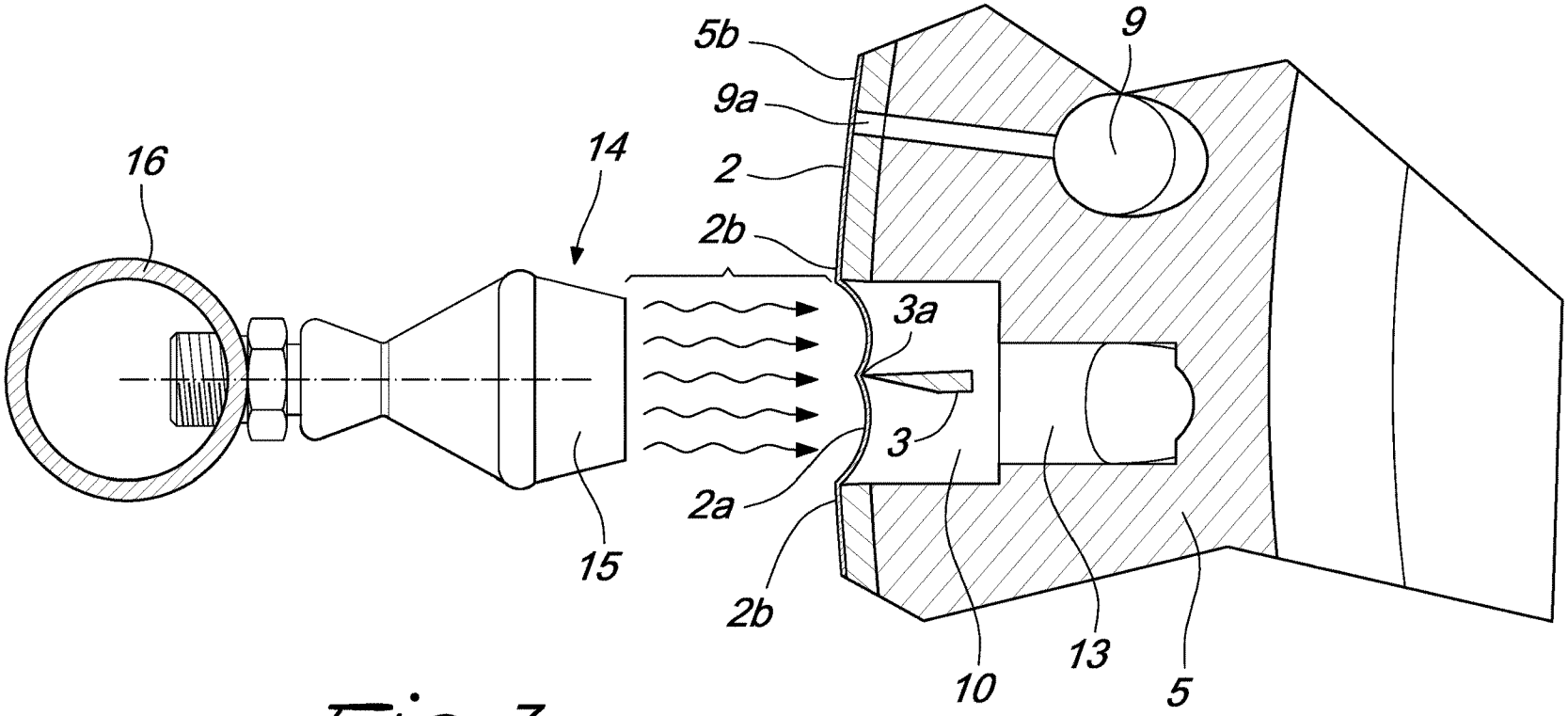
FIG. 7 is a schematic cross-sectional view, taken along a plane perpendicular to the axis of the supporting roller, of an alternative embodiment of the cutting device.

According to a possible variation of embodiment, shown in FIG. 7, the redirection means 4 can comprise means 14 of dispensing an air jet onto the face of the tape 2 which is opposite with respect to the blade 3 at the portion 2*a* of the tape 2 where the cutting occurs.

The dispensing means 14 can, for example, be provided by way of a nozzle 15 which is arranged so as to face the lateral surface 5*b* of the supporting roller 5 and which is supplied by a compressed air line 16.

In this case, the thrust exerted by the air jet dispensed by the nozzle 15 on the portion 2*a* of the tape 2 which is at the chamber 10 produces a redirection of such portion 2*a* from the advancement path of the tape 2 with consequent entry of the portion 2*a* into the chamber 10 and resting thereof, with a portion thereof which extends for its entire transverse dimension, against the cutting profile 3*a* of the blade 3 as shown in FIG. 7.

In this case also, the force with which the portion 2*a* is pushed by the air jet dispensed by the nozzle 15 against the cutting profile 3*a* of the blade 3 can be such as to produce the cutting of the tape 2, without the need to move the blade 3 with respect to the tape 2, and such cutting of the tape 2 can occur simultaneously along all of the portion of the tape 2 which is in contact with the cutting profile 3*a*.

Furthermore, in this case also, thanks to the fact that the portion 2*a* is moved, by the action of the air jet, from the advancement path of the tape 2 toward the blade 3 arranged within the chamber 10, the cutting of the tape 2 can occur on an inner diameter of the supporting roller 5.

It should be noted that there is no reason why the dispensing means 14 cannot, optionally, produce the movement of the portion 2*a* of the tape 2 inward into the chamber 10 in cooperation with the means of aspiration of air from the chamber 10, described above.

In another possible variation of embodiment, the redirection means 4 can comprise a guiding roller 17, the function of which is to engage the face of the tape 2 which is directed away from the blade 3, so as to be able to produce a movement in the direction of the blade 3 of a portion 2*a* of the tape 2 in which the cut is made, with respect to the advancement path of the tape.

Figure 8:
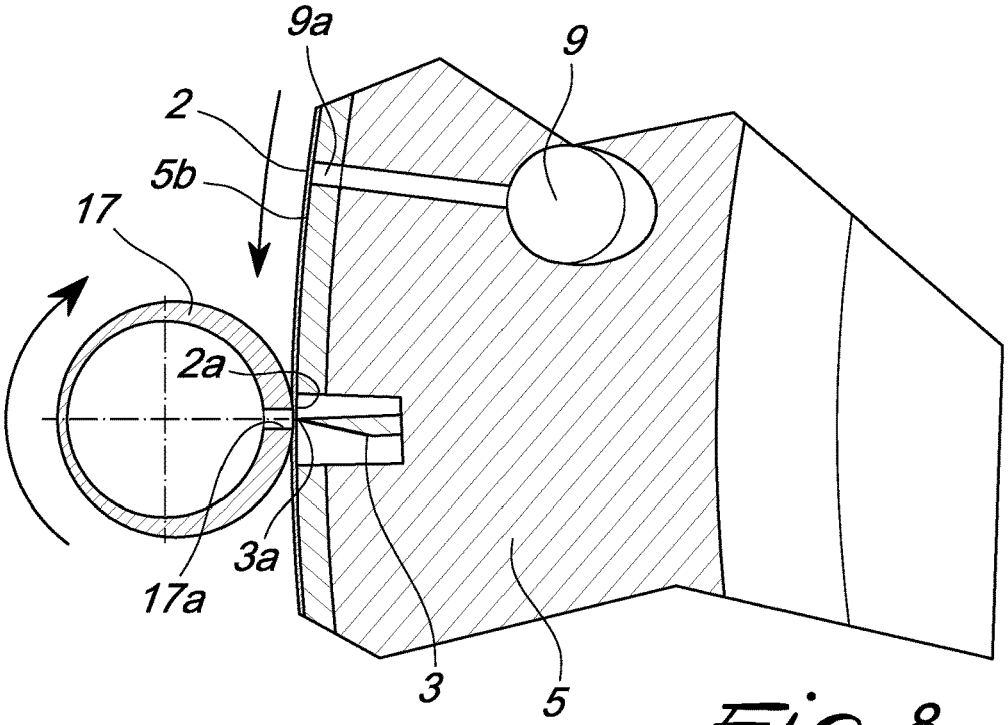
FIG. 8 is a schematic cross-sectional view, taken along a plane perpendicular to the axis of the supporting roller, of a further variation of embodiment of the cutting device.

Conveniently, as in the example shown in FIG. 8, the guiding roller 17 can be actuated in rotation about its own axis and is arranged adjacent to the supporting roller 5.

Advantageously, at least one part of the lateral surface of the guiding roller 17 is contoured so that it corresponds to the shape structure of the chamber 10 and of the blade 3.

More specifically, as illustrated in FIG. 8, the guiding roller 17 can have, for example, an eccentric shape structure with an indentation 17*a* which is defined on its lateral surface and is intended, during the rotation of the guiding roller 17, to receive the cutting profile 3*a* of the blade 3 or in any case to face toward it.

It should be noted that, in order to make it possible for the indentation 17*a* to face toward the blade 3 during the rotation of the supporting roller 5 and of the guiding roller 17, the rotation of the guiding roller 17 is, conveniently, synchronized with the rotary motion of the supporting roller 5 about its own axis 5*a*.

In this manner, the guiding roller 17, rotating about its own axis, can come into contact, at the part of its lateral surface which is contoured correspondingly to the blade 3 and to the chamber 10, with the tape 2, so as to press the portion 2*a* of the tape 2 engaged by it inward into the chamber 10.

Simultaneously, the cutting profile of the blade 3, by interacting with the guiding roller 17, produces the cutting of the tape 2.

As can be seen, similarly to the embodiments described previously, in this case also the cutting of the tape 2 is done at an inner diameter of the supporting roller 5 and occurs simultaneously along a portion of the tape 2 which extends for the entire transverse dimension of the tape.

Optionally, the supporting roller 5 can be arranged side by side with means of application of adhesive, not shown, which are adapted to apply a layer of adhesive onto the labels obtained as a result of the cutting of the tape 2 by the blades 3 which are present on the supporting roller 5.

Such means of application of adhesive can be constituted, for example, by a gluing roller or by an adhesive sprayer.

It should be noted that the tape 2 can also be of the pre-glued type and, in such case, conveniently, the tape 2 is made to adhere on the lateral surface 5*b* of the supporting roller 5 with its face which is without adhesive.

As can be seen from the schematic view in FIG. 1, the supporting roller 5 can also be designed to transfer individual labels, which are obtained as a result of the cutting of the tape 2, by the blades 3 which are present thereon, onto respective bottles 18, or containers in general, which are arranged on a conveyor 19, which can be of the carousel or linear type or of any type at all.

In this case, the supporting roller 5 can, in practice, carry out, thus, a function of cutting and transfer roller.

Figure 10:
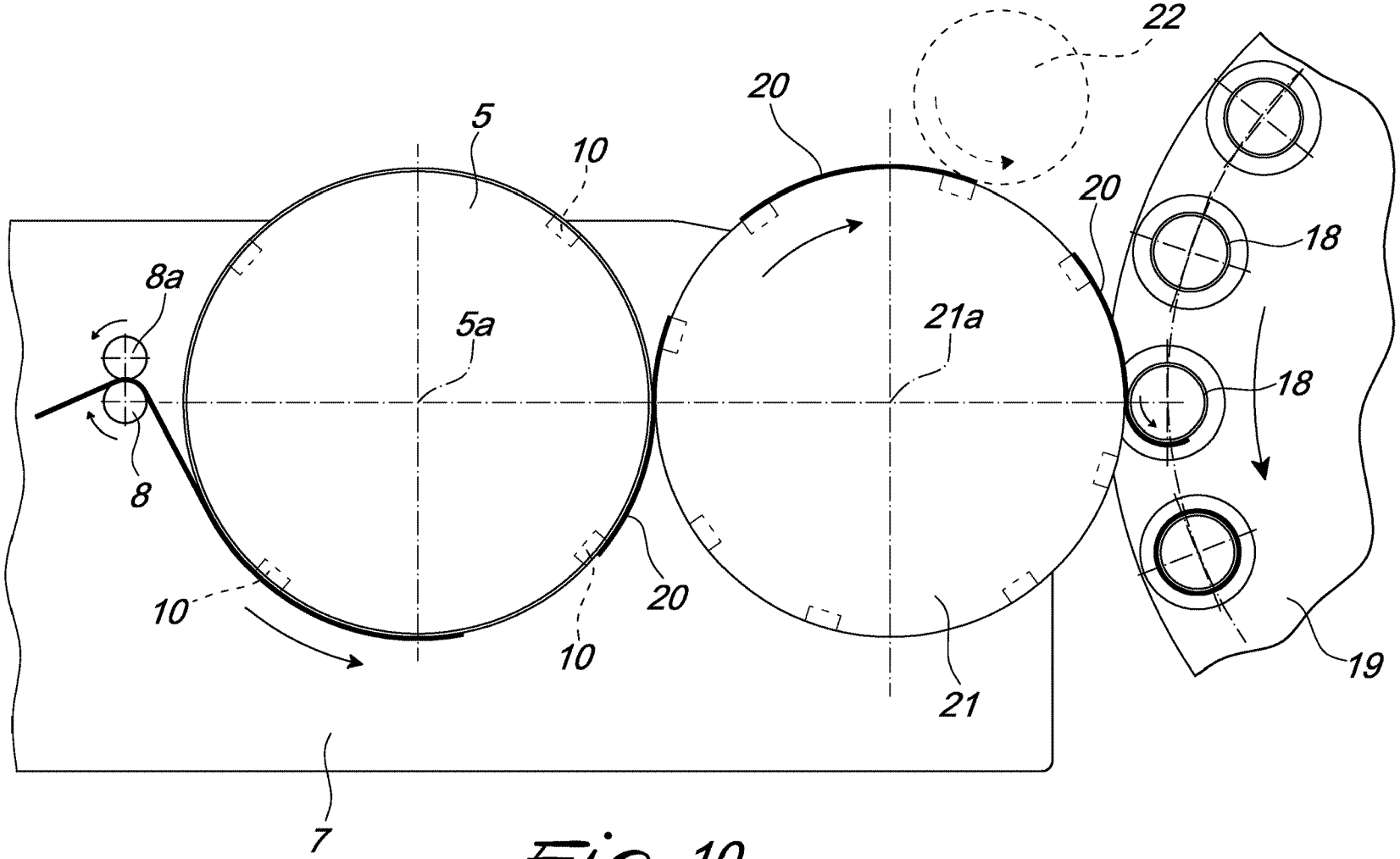
FIG. 10 is a view of a variation of embodiment of the machine according to the invention.

Alternatively, as shown in FIG. 10, there is no reason why the supporting roller 5 cannot also transfer the individual labels made as a result of the cutting of the tape 2 by its blades 3 to another roller and in particular to the transfer roller 21, which will subsequently transfer the labels to respective bottles 18 in transit on a conveyor 19.

In particular, the transfer roller 21 can move by rotation about its own axis 21*a* and, conveniently, it is provided with aspiration means in order to retain the labels received from the supporting roller 5 so that they adhere to its surface.

In this case, the supporting roller 5 will carry out, in essence, the sole function of cutting roller and the means of application of adhesive, which are constituted, for example, by an applicator roller 22, shown, by way of example, in dotted lines in FIG. 10, can be, optionally, provided proximate to such transfer roller 21, so as to provide the labels passed from the supporting roller 5 to the transfer roller 21 with at least one layer of adhesive, in order to enable their subsequent adhesion to the surface of the bottles 18 which arrive from the conveyor 19.

Figure 9:
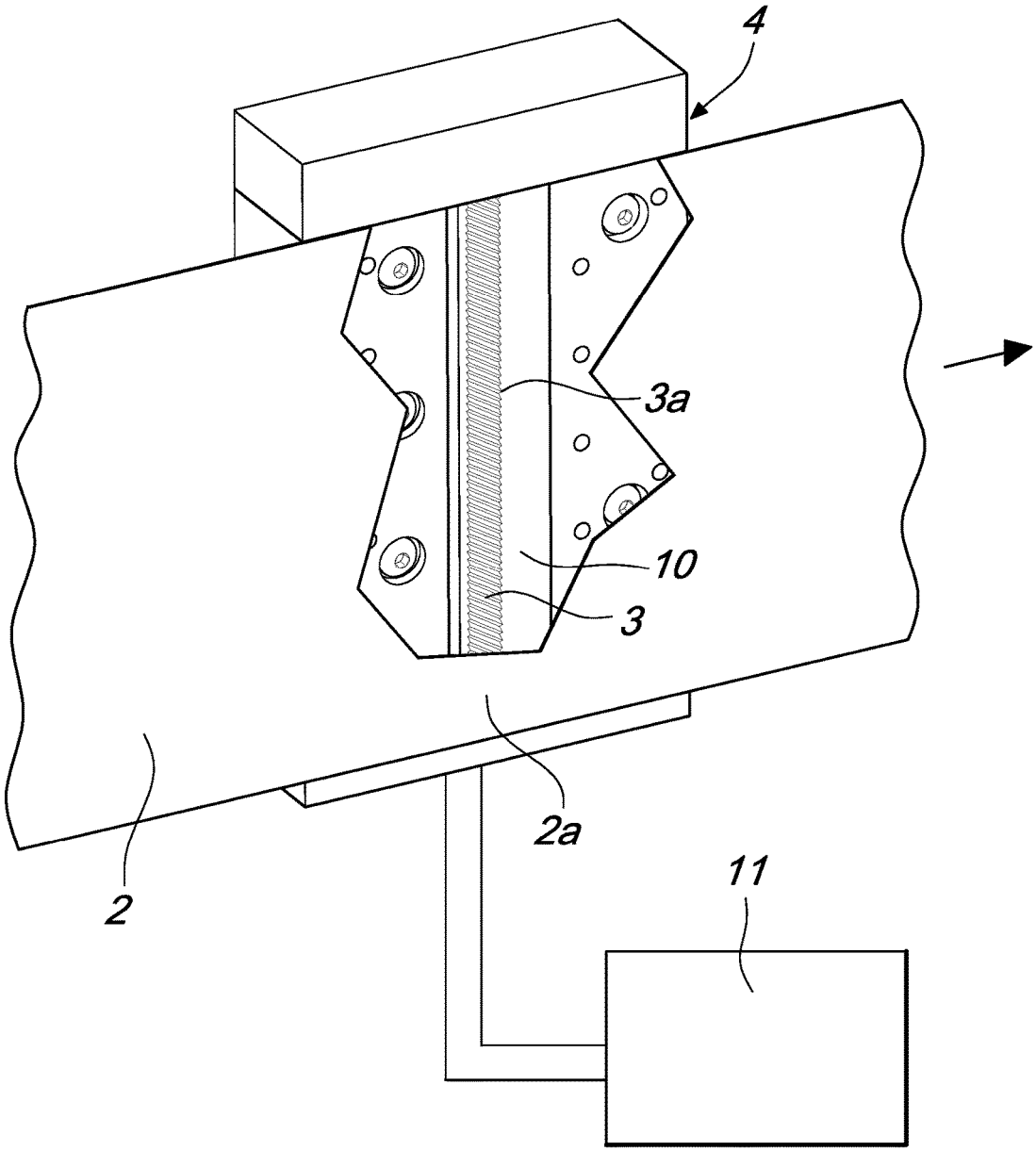
FIG. 9 is a perspective view of yet another embodiment of the cutting device.

With reference to FIG. 9, according to a further embodiment of the invention, the tape 2 is moved by entrainment means, not shown, with respect to at least one blade 3 according to a substantially straight advancement path.

More specifically, the movement of the tape 2 with respect to the blade 3 can, conveniently, occur, in this case, with intermittent straight motion.

Conveniently, as also illustrated in FIG. 9, the blade 3 is arranged so as to face, with its cutting profile 3*a*, toward a face of the tape 2 and there are redirection means 4 which make it possible to move the tape 2 from its advancement path toward the blade 3 and which comprise a chamber 10, in which the blade 3 is accommodated, which is open toward the tape 2 and connected to an air aspiration device 11, for creating a partial vacuum in the chamber 10 which can redirect the tape 2 toward the blade 3.

Operation of the device according to the invention is evident from the foregoing description.

In particular, with reference to the embodiment in FIGS. 1, 2 and 3, it should be noted that the tape 2 to be cut is fed from the unwinding roller 8 to the supporting roller 5 which receives it so that it adheres on its lateral surface 5*b*.

Rotating about its own axis 5*a*, the supporting roller 5 entrains the tape 2 along an advancement path.

During the rotation of the supporting roller 5, each one of the chambers 10 present on the supporting roller 5 is, in each instance, brought, with its air aspiration channel 13, into connection with the passage channel 12 and, thus, with the air aspiration device 11, with consequent creation within the chamber that is now connected to the air aspiration device 11 of a pressure that is less than that present in the environment outside that chamber.

The portion 2*a* of the tape 2 which is arranged at the chamber 10 which is now connected to the aspiration device 11, is, thus, sucked into that chamber and brought up against the cutting profile 3*a* of the blade 3, so as to obtain the cutting of the tape 2.

It is also possible that the aspiration device 11 can be activated only upon the passing of certain chambers 10 present on the supporting roller 5, so as to be able to vary, in essence, without changing the supporting roller 5, the maximum cutting pitch i.e. the distance between the blades 3 that are effectively used, of all those available, to cut the tape 2.

Alternatively, a similar result can optionally be obtained by stoppering, by way of adapted caps, the chambers 10 corresponding to the blades 3 that it is intended not to use and keeping the aspiration device 11 always activated.

It should be noted that the format of the labels can further be varied by varying the quantity of tape fed by the unwinding roller 8 to the supporting roller 5 and/or by substituting the supporting roller 5 with another supporting roller with a different number of blades 3 and/or a different diameter.

Following the cutting, a label 20 is detached from the tape 2 and remains adhered to the lateral surface of the supporting roller 5.

With reference to the embodiment in FIG. 1, if necessary, on the face of the label obtained which is directed away with respect to the supporting roller 5, a layer of adhesive is optionally applied by the above mentioned application means, in order to allow its subsequent adhesion to a respective bottle.

At this point, continuing in the rotation about its own axis 5*a*, the supporting roller 5 brings the label 20 obtained to the conveyor 19 of the bottles 18, thus allowing the transfer of that label onto a bottle 18 arriving on the conveyor 19, thus achieving the labeling thereof.

With reference, on the other hand, to the variation in FIG. 10, each label 20 obtained on the supporting roller 5 is transferred from the supporting roller 5 to the transfer roller 21, remaining adhered thereto. The applicator roller 22, optionally present if necessary, applies a layer of adhesive to the opposite face of the labels 20 with respect to the face adhering to the transfer roller 21. Continuing in its rotary motion, the transfer roller 21 thus brings the labels 20 to adhere to the surface of a respective bottle 18 which is in transit on the conveyor 19, thus carrying out the labeling thereof.

For the embodiment in FIG. 7, the movement of the portion 2*a* of the tape 2 against the blades 3 associated with the supporting roller 5 occurs by the action, or with the contribution, of the air jet emitted by the dispensing means 14 against the tape 2.

It is possible for the air jet to be emitted constantly by the dispensing means 14. In this case, at the passage of each chamber 10 before the dispensing means 14, each portion 2*a* of the tape 2 which is now at the chambers 10, not having the support of the lateral surface of the supporting roller 5, will be pushed up against the corresponding blades 3.

Alternatively, the dispensing means 14 can be activated only at the passage before them of certain chambers 10 so as to be able to execute the cutting of the tape 2 with the blades 3 corresponding to those chambers and thus obtain labels of different length.

In this case also the variation of the format of the labels obtained can be done by substituting the supporting roller 5 with another supporting roller that has a different number of blades 3 and/or a different diameter.

With regard to the embodiment shown in FIG. 8, the movement of the portion 2*a* in order to carry out the cutting of the tape 2 is imparted by the guiding roller 17. In particular, in this case the rotation of the guiding roller 17, suitably synchronized with the rotary movement of the supporting roller 5, enables the guiding roller 17 to act on the portions 2*a* of the tape 2 that are at the (or some) chambers 10 in order to move them up against the corresponding blades 3 and thus obtain the cutting of the tape 2.

With reference to the embodiment in FIG. 9, the tape 2 is imparted a relative motion, with respect to the blade 3, along a substantially straight advancement path for a portion of path that is substantially equal to the length of the labels to be provided.

Then, the redirection means 4 are activated and, more specifically, the aspiration device 11 is activated, so as to create a partial vacuum in the chamber 10 which is capable of redirecting the portion 2*a* of the tape 2 from the advancement path toward the blade 3, until the portion 2*a* of the tape 2 is pushed up against the cutting profile 3*a* of the blade 3 and, as a consequence, the tape 2 is cut, and a label is obtained.

Conveniently, the motion of the tape 2 along the substantially straight advancement path can be intermittent, at each stop of the tape 2 its cutting being carried out at its portion 2*a* which in each instance is brought to the blade 3.

From the foregoing it can be seen that the invention fully achieves the set aim and objects and, in particular, attention is drawn to the fact that the machine according to the invention, thanks to its cutting device, makes it possible to carry out the cutting of the tape in order to obtain labels without necessarily requiring the actuation of a movement of the blades, with a consequent simplicity of construction which results in lower construction costs with respect to the known art.

Another advantage of the present invention is that it allows, without changing the supporting roller, an easy variation of the maximum cutting pitch, by way of an adjustable activation of the means of redirection of the tape as a function of the desired length for the labels.

Furthermore, another important advantage of the invention is that it is highly versatile in changing the format of the labels thanks in part to the interchangeability of a roller on which the tape can be cut, which has a structure that is far less complex than the examples of the known art; in particular, the cutting device according to the invention has the advantage of being able, in each instance, to be fitted out, as a function of the desired label format, using different interchangeable support rollers, which have different diameters and/or different numbers of blades, which, being very simple in terms of construction, at least in the case where means of actuation of the blades are not envisaged, are, as a consequence, very low cost.

Another advantage of the invention is that it allows the execution of the cutting of the tape within a chamber that accommodates the blade i.e. on a smaller diameter than that on which the tape is supported on the supporting roller or on which the adhesive is applied on it, with consequent lower exposure of the blades to wear or to deterioration and, possibly, to interference, for example, with the means of application of adhesive.

Another advantage of the present invention is that of being able to carry out the cutting of the tape practically simultaneously, and not gradually as in the known art, along the entire cutting line that extends transversely to the tape, as a consequence obtaining a cleaner cut and less deformation of the tape.

Another advantage of the machine according to the invention is that it can be used both with pre-glued tapes and with tapes that necessitate the application of adhesive, thus offering a high versatility of use.

All the characteristics of the invention, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The disclosures in Italian Patent Application No. VR2014A000132 from which this application claims priority are incorporated herein by reference.

The invention claimed is:

1. A labeling machine comprising: an advancement path that follows a support surface, and means for entraining a tape along said advancement path with respect to a cutting device that has at least one blade adapted to cut said tape in order to obtain labels, wherein said at least one blade is arranged laterally spaced apart with respect to said advancement path in a slot of the support surface, and redirection means for producing a force that moves at least one portion of said tape out of said advancement path and into said slot in a direction toward at least one cutting profile of said at least one blade in order to allow said blade to cut said tape at said at least one portion, wherein said redirection means comprises means for differentiating, at said slot, the pressure of air that acts on a first face of said tape with respect to the pressure of air that acts on a second face of said tape.

2. The machine according to claim 1, wherein said at least one cutting profile is arranged so as to face said first face of said tape.

3. The machine according to claim 2, wherein said redirection means comprises redirection means for producing a force that moves at least one portion of said tape out of said advancement path and into said slot and into contact with said cutting profile of said at least one blade.

4. The machine according to claim 1, wherein said support surface is defined by an outer surface of a supporting roller, which supporting roller can rotate about an axis thereof and is adapted to receive said tape so that it adheres to said support surface.

5. The machine according to claim 4, wherein said at least one blade rotates integrally with said supporting roller and is arranged in said slot and is spaced apart with respect to said support surface.

6. The machine according to claim 4, wherein said at least one blade is arranged in said slot between said support surface and the axis of said supporting roller.

7. The machine according to claim 1, wherein said at least one blade is fixed with respect to at least parts of said tape that are arranged adjacent to said at least one portion, at least during the cutting of said tape.

8. The machine according to claim 1, wherein said blade can be actuated so as to move with respect to said at least one portion in order to cut said tape within said slot at said at least one portion.

9. The machine according to claim 1, wherein said redirection means comprise aspiration means for aspirating air from a side of the first face of said tape, which first face is directed toward said at least one blade.

10. The machine according to claim 9, wherein said aspiration means act in a region that is adjacent to said at least one blade.

11. The machine according to claim 1, wherein said means for differentiating comprise aspiration means for aspirating air from a side of the first face of said tape, which first face is directed toward said at least one blade and wherein said aspiration means are connected to said slot.

12. The machine according to claim 1, wherein said means for differentiating comprise means for delivering an air jet onto the second face of said tape, which second face is opposite with respect to said at least one blade at said at least one portion.

13. The machine according to claim 4, wherein said supporting roller is flanked by means for applying glue to the labels obtained following the cutting of said tape by said at least one blade.

14. The machine according to claim 4, wherein said supporting roller is adapted to transfer individual labels obtained as a consequence of the cutting of said tape by said at least one blade onto respective bottles which are arranged on a conveyor, so as to act as a cutting and transfer roller, or onto a transfer roller that is preset to transfer the individual labels received from said supporting roller onto respective bottles that arrive from a conveyor.

15. A labeling machine comprising:

an advancement path that follows a support surface of a supporting roller, where a slot is located in said support surface, and said advancement path extends across said slot;

means for entraining a tape along said advancement path with respect to a cutting device that has at least one blade with at least one cutting profile adapted to cut said tape in order to obtain labels, wherein said at least one cutting profile is laterally spaced apart from said advancement path within said slot; and redirection means for producing a force that acts on a portion of said tape to move said portion of said tape out of said advancement path and into said slot and toward said at least one cutting profile in said slot in order to allow said at least one blade to cut said portion of said tape while said portion of said tape is laterally offset from said advancement path and within said slot, wherein said redirection means comprises means for differentiating, at said slot, the pressure of air that acts on a first face of said tape with respect to the pressure of air that acts on a second face of said tape.

* * * * *